US007068220B2

(12) United States Patent
DeNatale et al.

(10) Patent No.: US 7,068,220 B2
(45) Date of Patent: Jun. 27, 2006

(54) LOW LOSS RF PHASE SHIFTER WITH FLIP-CHIP MOUNTED MEMS INTERCONNECTION

(75) Inventors: Jeffrey F. DeNatale, Thousand Oaks, CA (US); Jonathan B. Hacker, Thousand Oaks, CA (US); Robert E. Mihailovich, Newbury Park, CA (US); William R. Norvell, Richardson, TX (US)

(73) Assignee: Rockwell Scientific Licensing, LLC, Thousand Oaks, CA (US)

( * ) Notice: Subject to any disclaimer, the term of this patent is extended or adjusted under 35 U.S.C. 154(b) by 331 days.

(21) Appl. No.: 10/675,606

(22) Filed: Sep. 29, 2003

(65) Prior Publication Data

US 2005/0068123 A1 Mar. 31, 2005

(51) Int. Cl.
*H01P 1/18* (2006.01)
*H01Q 3/32* (2006.01)

(52) U.S. Cl. ..... 342/375; 333/156; 333/161; 333/105

(58) Field of Classification Search ..... 333/164, 333/161, 156, 105, 262; 342/372, 375
See application file for complete search history.

(56) References Cited

U.S. PATENT DOCUMENTS

| | | | | |
|---|---|---|---|---|
| 5,578,976 | A | 11/1996 | Yang et al. | 333/262 |
| 5,880,921 | A | 3/1999 | Tham et al. | 361/233 |
| 5,959,516 | A | 9/1999 | Chang et al. | 334/14 |
| 6,225,692 | B1 | 5/2001 | Hinds | 257/698 |
| 6,281,838 | B1 | 8/2001 | Hong | 342/371 |
| 6,538,603 | B1 | 3/2003 | Chen et al. | 342/372 |
| 6,686,885 | B1 * | 2/2004 | Barkdoll et al. | 343/700 MS |
| 6,741,207 | B1 * | 5/2004 | Allison et al. | 342/371 |

FOREIGN PATENT DOCUMENTS

| | | | |
|---|---|---|---|
| EP | 0709911 | A2 | 5/1996 |
| EP | 0840394 | A2 | 5/1998 |
| WO | WO0209224 | A1 | 1/2002 |

OTHER PUBLICATIONS

"High Isolation CPW MEMS Shunt Switches Part 2: Design", IEEE Transactions on Microwave Theory and Techniques, Dec. 1999, Muldavin et al., p. 1–4.
"Quick Prototyping of Flip Chip Assembly with MEMS", Irwin, et al., 1998, NSF Center for Advanced Manufacturing and Packaging of Microwave, Optical and Digital Electronics, Dept of Mechanical Engineering University of Colorado, Boulder, Co., 8 pages.
"Flip–Chip Assembly for Si–Based RF MEMS", Proceedings of the 12th IEEE International Conf. on Microelectromechanical Systems (MEMS 99), Jan. 1999, pp 273–278.

(Continued)

*Primary Examiner*—Benny Lee
(74) *Attorney, Agent, or Firm*—Koppel, Jacobs, Patrick & Heybl

(57) ABSTRACT

A hybrid circuit phase shifter assembly of RF MEMS switch modules and passive phase delay shifter circuits uses a low loss, preferably flip-chip, interconnection technology. The hybrid circuit assembly approach separates the fabrication of the MEMS switch modules from the fabrication of the passive phase delay circuits thereby avoiding process incompatibilities and low yields and providing substantial production cost savings. In another aspect of the invention, the integration on a common substrate of a MEMS-based hybrid circuit phase shifter assembly behind each of a plurality of radiating elements provides a compact, low cost electronic scanning antenna array.

15 Claims, 3 Drawing Sheets

OTHER PUBLICATIONS

Harsh K F. et al., *Flip–Chip Assembly for Si–Based RF MEMS*, Micro Electro Mechanical Systems, 1999, MEMS '99 Twelfth IEEE International Conference on Orlando, FL, USA 17–21, Jan. 1999 pp 273–278.

Kim M. et al. *MEMS True–Time Delay Circuit for Broadband Antennas*, IEEE Antennas and Propagation Society International Symposium. 2001 Digest. APS. Boston, MA, Jul. 8–13, 2001, New York, NY, IEEE, US, vol. 3 of 4, Jul. 8, 2001, pp. 662–665.

PCT Notification of Transmittal of the International Search Report (3 pages) Feb. 11, 2005.

International Search Report (4 pages) Feb. 11, 2005.

PCT Written Opinion of the International Searching Authority, (5 pages) Feb. 11, 2005.

* cited by examiner

FIG. 3
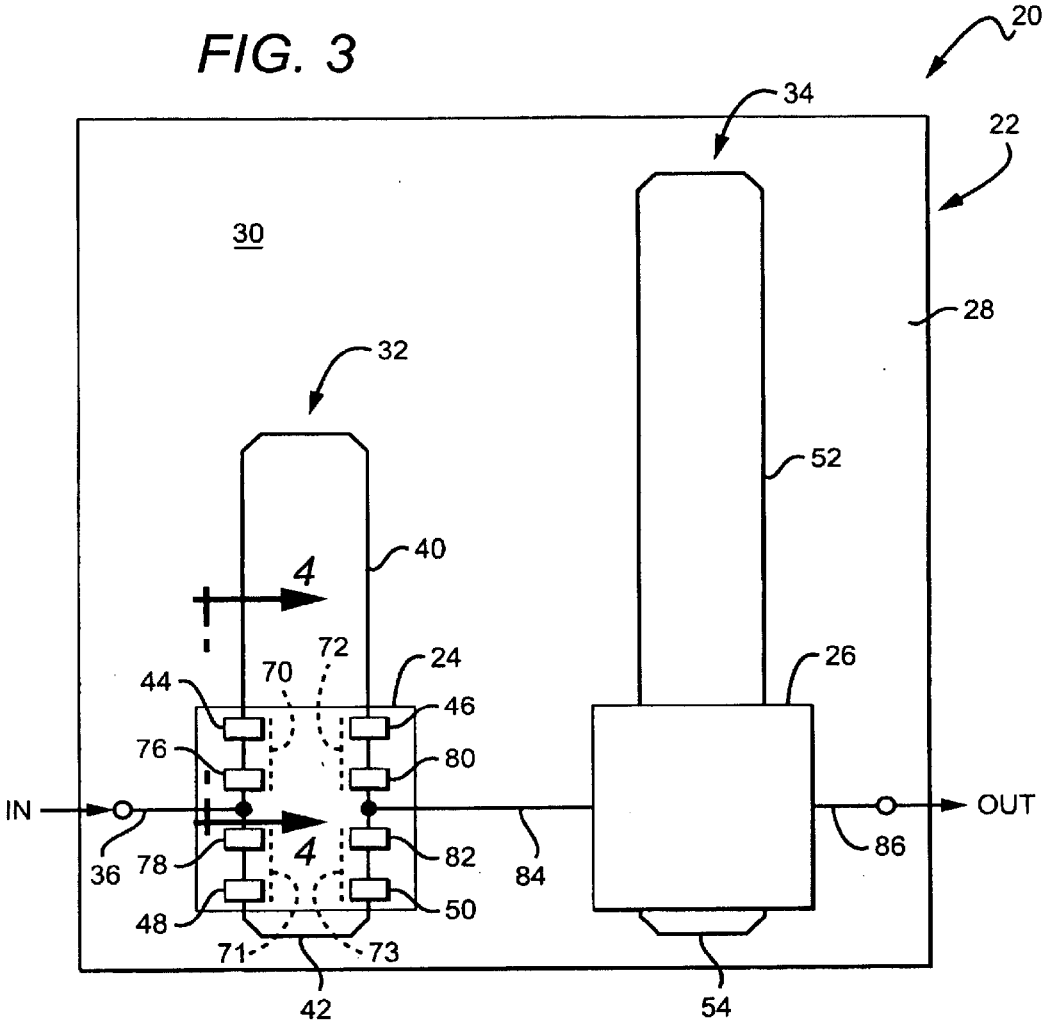
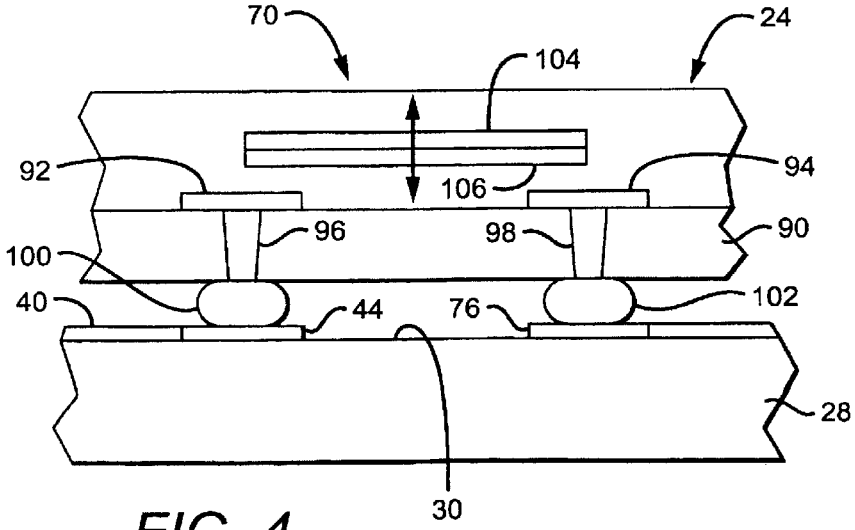
FIG. 4

FIG. 5
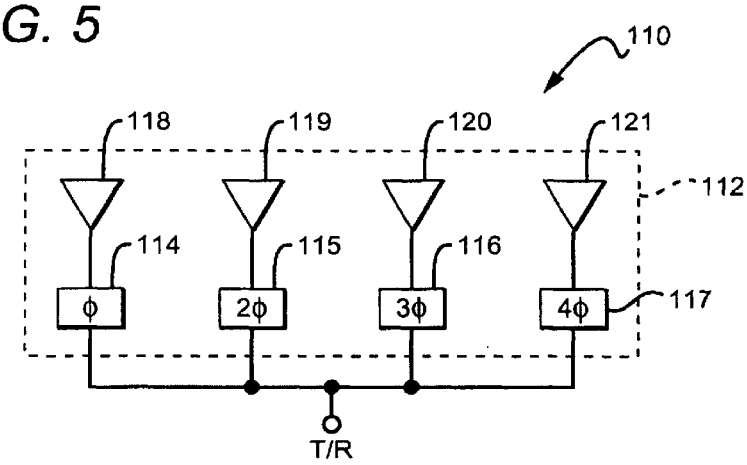
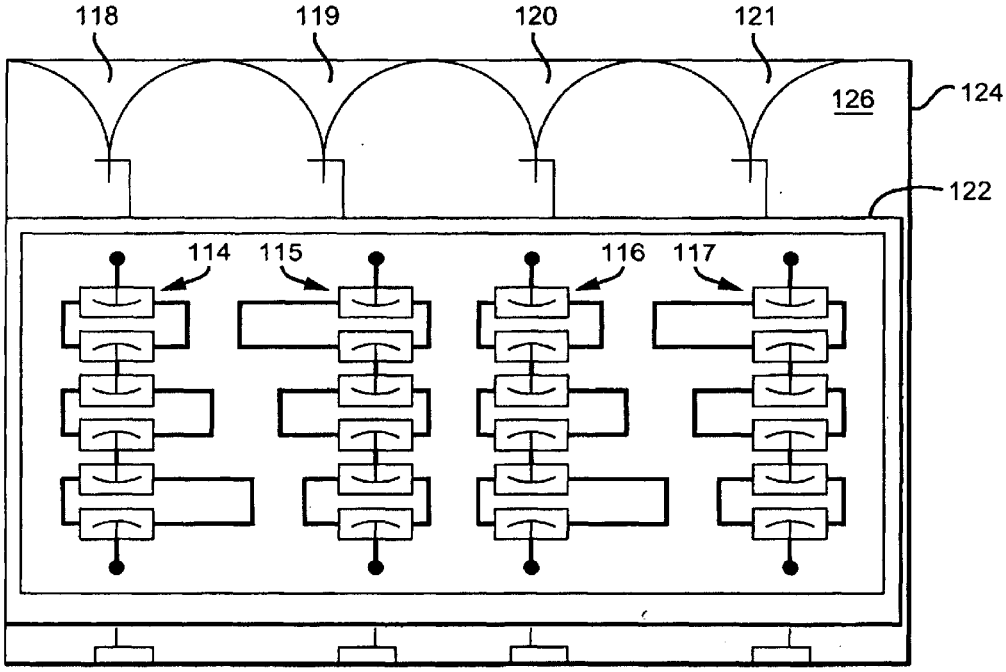
FIG. 6

LOW LOSS RF PHASE SHIFTER WITH FLIP-CHIP MOUNTED MEMS INTERCONNECTION

BACKGROUND OF THE INVENTION

1. Field of the Invention

This invention relates generally to phase shifters utilized, for example, in electronically scanned phase array antennas, and particularly to phase shifter circuits incorporating low loss, RF microelectromechanical (MEMS) switches.

2. Description of the Related Art

The beam of a multiple element or array antenna may be propagated at a predetermined angle by inserting an appropriate phase shift in the radiated signal at each element of the array.

FIG. 1 is a simplified diagram of one row of a conventional phased array antenna 10 utilizing electronic beam steering, a complete planar phased array antenna having a number of such rows. The antenna 10 includes a plurality of radiating elements 12 each of which has its own phase shifter 14. An input line 16 carrying a transmission signal is coupled to each phase shifter 14, which imparts a respective predetermined phase shift ($\phi$, $2\phi$, $3\phi$ and $4\phi$, respectively) to the transmission signal as it passes through that phase shifter. The phase shifted transmission signals are then coupled to respective radiating elements 12 for propagation of the beam. Various types of phase shifters 14 have been developed, including switched-line phase shifters, reflection-line phase shifters and loaded-line phase shifters.

An example of switched-line phase shifters is the true time delay (TTD) phase shifter circuit in which rapid phase changes for electronically scanning the beam are obtained by selectively inserting and removing discrete lengths of transmission lines by means of high speed electronic switches. For example, with a cascaded switch arrangement, a relatively small number of preselected transmission line lengths can be series-connected in various combinations to provide a substantial number of discrete delays. Thus, a cascaded four-bit switched phase shifter can insert sixteen different phase shift levels into the propagated signal.

By virtue of their superior isolation and insertion loss properties, RF MEMS switches are advantageous for implementing high performance, electronically scanned antennas. However, conventional MEMS-based TTD phase shifters employ monolithic architectures that present processing compatibility, cost and packaging problems. For example, although most of the monolithic die area simply comprises easily fabricated passive metal delay lines, a monolithic architecture requires processing of the entire phase shifter circuit through a series of complex, multi-level MEMS switch fabrication steps. This not only results in low yields and high product costs, but as a result of incompatibilities between the delay line and MEMS switch fabrication processes, also restricts the materials that can be used.

SUMMARY OF THE INVENTION

Broadly, the invention provides a hybrid circuit assembly of RF MEMS switch modules and passive phase delay shifter circuits using a low loss, preferably flip-chip, interconnection technology. This hybrid circuit assembly approach separates the fabrication of the MEMS switch modules from the fabrication of the passive phase delay circuits thereby avoiding process incompatibilities and low yields and providing substantial production cost savings.

As is known, unlike assembly techniques that rely on bonding wires or beam leads to patterns outside of the die's perimeter, flip-chip technology employs direct electrical connections between termination pads on a die face and on the substrate. These short interconnecting conductor lengths reduce losses, optimize circuit performance and permit more efficient use of the substrate area.

The flip-chip interconnection preferably comprises solder bumps at all of the die-bonding pad locations which are terminated simultaneously by a controlled reflow soldering operation. Alternatively, instead of solder bumps, the interconnects may comprise indium columns, plated-through holes, metal-to-metal thermocompression bonds, conductive polymers, and the like.

In another aspect of the invention, the integration on a common substrate of the above-described MEMS-based phase shifter circuit behind each of a plurality of radiating elements provides a compact, low cost electronic scanning antenna array. The benefits of the invention include low insertion and return losses, low power consumption, broad bandwidth and ease of integration into higher assemblies.

BRIEF DESCRIPTION OF THE DRAWINGS

Further features and advantages of the invention will be apparent to those skilled in the art from the following detailed description when taken together with the accompanying drawings, in which:

FIG. 3 is a schematic of one specific embodiment of a hybrid circuit assembly in accordance with the invention;

FIG. 4 is a schematic, side elevation view, partly in cross section, of the hybrid assembly of FIG. 3 as seen along the line 4—4 in FIG. 3;

FIG. 5 is a schematic of an integrated phased array electronic scanning antenna in accordance with another aspect of the present invention; and FIG. 6 is a more detailed representation of the integrated electronic scanning antenna of FIG. 5.

DETAILED DESCRIPTION OF THE INVENTION

A preferred embodiment of the present invention comprises a phased array antenna phase shifter with one or more stages, each stage comprising two or more passive phase delay circuits and utilizing switched selection of the delay circuits at each stage. The phase shifter of the invention uses low loss RF MEMS switches for selecting the desired delay circuit(s) within each stage. While a preferred embodiment described in detail herein incorporates TTD switched-line phase shifter architecture, the application of this invention to other phase shifter architectures incorporating other kinds of passive elements (such as capacitors and inductors) will be apparent to those skilled in the art.

Figure 1:
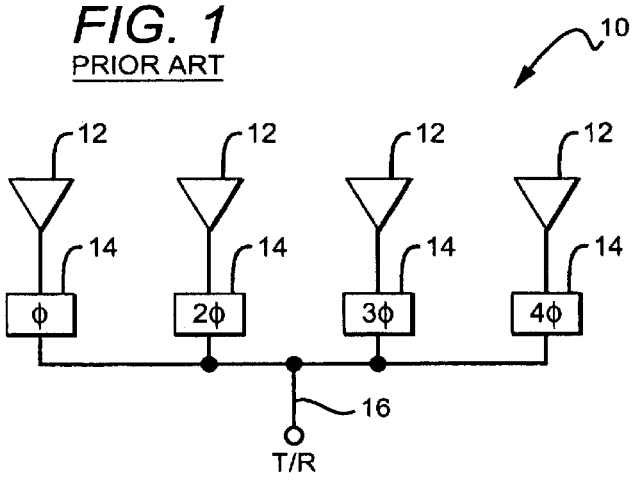
FIG. 1 PRIOR ART
FIG. 1 is a schematic representation of a conventional phased array electronic scanning antenna.
Figure 2:
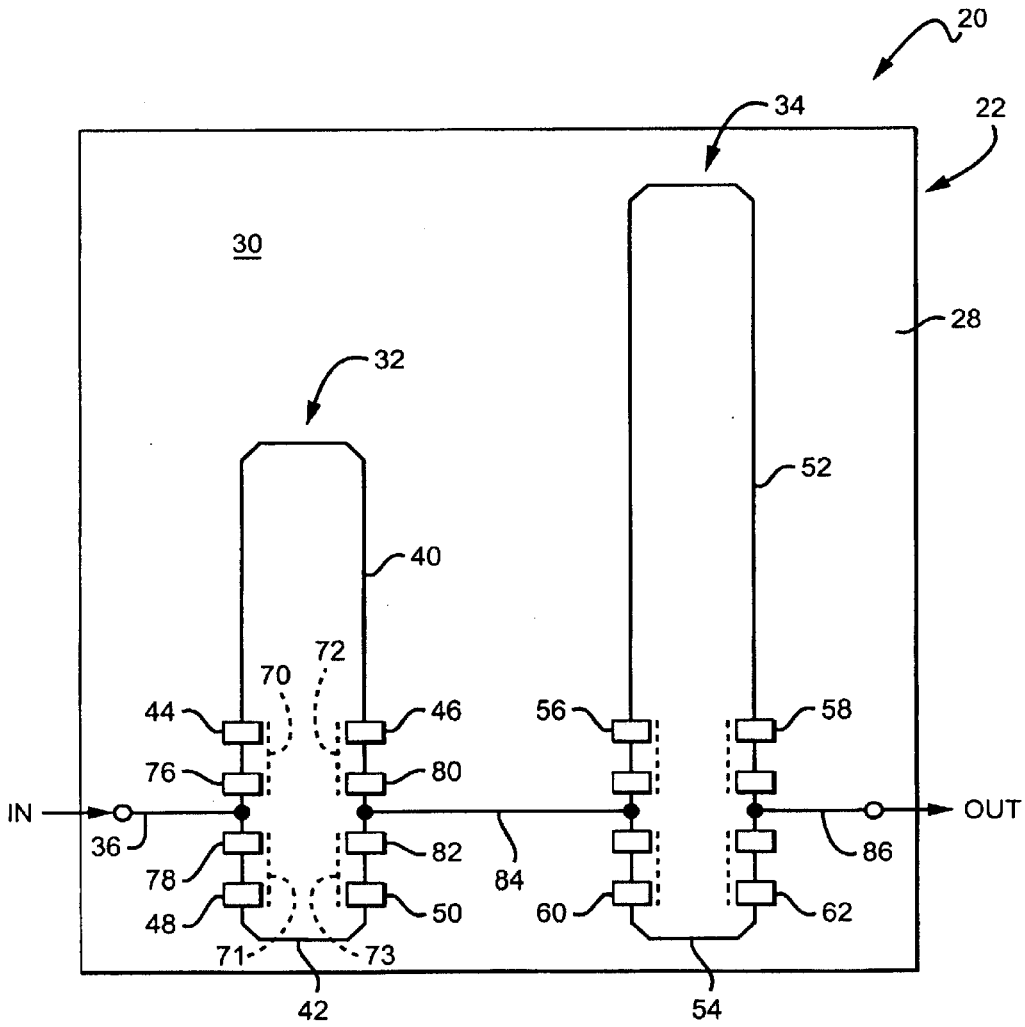
FIG. 2 is a schematic of one specific example of a passive phase shifter circuit that may be used in the present invention.

A preferred embodiment shown in FIGS. 2 and 3 comprises a hybrid phase shifter assembly 20 including a 2-bit digital delay line module 22 carrying a pair of flip-chip MEMS switch modules 24 and 26 (see FIG. 3 ). As best seen in FIG. 2, the digital delay line module 22 comprises a base substrate 28 fabricated of an insulating material such as alumina, quartz, or a microwave ceramic, or a semi-insulating material such as high-resistivity silicon or GaAs.

Patterned on a surface 30 of the substrate 28 are a pair of serially connected delay line stages 32 and 34 for inserting a cumulative time delay in a transmission signal, "IN" (generally the base carrier frequency of the antenna) appearing on an input line 36 coupled to the first delay line stage 32. More stages may be used so as to provide higher beam steering resolution.

The first time delay stage 32 comprises two planar strip delay lines 40 and 42 patterned on the base substrate 28. The delay line 40 has a pair of terminal pads 44 and 46; similarly, the delay line 42 has terminal pads 48 and 50. The two delay lines 40 and 42 have different lengths thereby imparting different time delays to the transmission signal. The delay line 42 may interpose a reference time delay that may, for example, be substantially zero. The time delay is equivalent to the time it takes the transmission signal to transit one of the two delay lines 40 and 42 and the longer the delay line, the greater the time delay. The phase of the transmission signal is shifted in proportion to the time delay.

Like the first time delay stage 32, the second time delay stage 34 comprises two delay lines 52 and 54 patterned on the base substrate 28. The delay line 52 includes a pair of terminal pads 56 and 58; similarly, the delay line 54 has a pair of terminal pads 60 and 62. In the example shown, the delay line 52 of the second stage 34 is longer than the delay line 40 of the first stage 32 while the second delay line 54 may have the same length as the delay line 42 so as to provide an identical reference time delay.

With reference to FIG. 3, one of the two delay lines 40, 42 in the first time delay stage 32 is activated by closing two of four MEMS input and output switches 70–73 to connect the selected delay line into the overall phase shifter. The input switch 70 is operable to electrically connect an input line terminal pad 76 with the terminal pad 44 of the delay line 40; input switch 71 electrically connects an input line terminal 78 with the pad 48 of the delay line 42; similarly, output switches 72 and 73 are operable to connect the terminal pads 46 and 50 with stage output terminal pads 80 and 82, respectively. The stage output terminal pads 80 and 82 are coupled to a line 84 that interconnects the delay line stages 32 and 34.

In the second time delay stage 34, additional phase shift may be imparted to the transmission signal in the same manner as in the first time delay stage 32 by closing respective input and output switches within the second stage MEMS switch module 26. After passing through the second time delay stage 34, the phase-shifted signal, "OUT", appears on an output line 86 and from there may be passed through additional time delay stages (not shown) where, for higher resolution, still additional phase shifts can be inserted by closing selected MEMS switches in the same manner as in the two previous time delay stages.

The RF MEMS modules 24 and 26 contain switches that are preferably of the metal-to-metal contact switches of the type disclosed, for example, in U.S. Pat. No. 5,578,976 owned by the assignee of the present invention; the '976 patent is incorporated herein by reference for its teachings of the structure of such switches and methods for their fabrication. It will be evident that other MEMS switch types may be used instead.

A simplified cross-section of a portion of the MEMS module 24 showing switch 70 in greater detail is depicted in FIG. 4. It will be understood that the module 24 merely typifies the MEMS modules that may be used in the invention. The switches carried by the MEMS module 24 are formed on a substrate 90 using generally known microfabrication techniques such as bulk micromachining or surface micromachining. While FIG. 4 illustrates an example in which the MEMS module 24 contains four separate switches, it will be understood by those skilled in the art that MEMS module configurations containing one or more switches may be used.

Formed on an upper surface of the MEMS substrate 90 are a pair of spaced-apart, fixed metallic contacts 92 and 94 in vertical alignment with the terminal pads 44 and 76, respectively, formed on the base substrate. The MEMS module 24 and base substrate 28 comprise a flip-chip assembly. More specifically, the contacts 92 and 94 are electrically connected to the terminal pads 44 and 76 on the base substrate by vias 96 and 98 extending through the MEMS substrate 90 and by electrical flip-chip interconnects 100 and 102 on the underside of the substrate. Although the interconnects 100 and 102 preferably comprise solder bumps, other low loss flip-chip interconnection techniques may be used, including but not limited to indium columns, plated-through holes, metal-to-metal thermocompression bonds, conductive polymer bonds, and so forth. Positioned above the fixed contacts 92 and 94 and spanning the gap therebetween is a vertically movable arm 104 carrying a metallic bridging contact 106 on a bottom surface thereof. The arm 104 may comprise a cantilevered structure of the kind that is well known in the MEMS switch art and that is typically formed of an insulating material such as silicon dioxide or silicon nitride. The movable contact 106 provides electrical continuity between the fixed contacts 92 and 94 (and hence the terminal pads 44 and 76) when the switch is actuated. While the MEMS switch 70 illustrated is of the ohmic contact type providing an electrically conductive path upon closure, the invention can also be implemented using capacitive switches that couple the signal through a thin insulating layer upon closure. For simplicity, the movable contact 106 is shown in FIG. 4 directly bridging the gap between stationary contacts 92 and 94. In an actual structure, surface conductors may be used to permit arbitrary location of the contact 92 relative to the via 96. Further, while FIG. 4 illustrates a face-up configuration in which the MEMS switch is on the top surface of the MEMS substrate 90 and is interconnected using through-substrate vias, the invention also encompasses face-down hybrid integration of the switch module 24 and the substrate 28. Face-down hybrid integration obviates the need for through-substrate conductive paths such as the vias 96 and 98.

The MEMS switch 70 is actuated when an appropriate stimulus is provided. For example, for an electrostatically actuated MEMS switch a drive voltage is applied between the movable and fixed contacts. The drive voltage creates an electrostatic force that attracts the movable contact 106 into engagement with the fixed contacts 92 and 94 thereby bridging the gap between the fixed contacts and providing an electrically conductive path between the contacts and hence the terminal pads 44 and 76 on the base substrate. Other switch actuation techniques may be used, including without limitation, thermal, piezoelectric, electromagnetic, gas bubble, Lorentz force, surface tension, or combinations of these. The present invention may employ MEMS switches operated by any of these methods or others known to those skilled in the art.

FIGS. 5 and 6 show an integrated electronic scanning array antenna 110 implementation (see FIG. 5 ) incorporating multiple phase shifters in accordance with the present invention. FIGS. 5 and 6 show a single package 112 (see FIG. 5) integrating four hybrid phase shifter assemblies 114, 115, 116 and 117 feeding time-delayed signals ($\phi$, $2\phi$, $3\phi$ and 4ϕ, respectively, in FIG. 5) to corresponding antenna elements or radiators 118, 119, 120 and 121. The package may be hermetically sealed by a single lid or cover 122 (FIG. 6) whose seal footprint does not intercept any of the elements patterned on the base substrate. Although FIGS. 5 and 6 show four hybrid assembly phase shifters in a single package, it will evident that any number of phase shifters may be employed within a package.

The package of FIGS. 5 and 6 comprises a common base substrate 124 of an insulating material such as alumina, quartz, or a microwave ceramic, or a semi-insulating material such as high resistivity silicon or GaAs. As is known in the art, the base substrate 124 may be a multi-layer microwave material with embedded conductors. The antenna elements or radiators 118–121 are printed onto a surface 126 of the substrate 124 or formed using an interior metal layer in a multi-layer substrate along with TTD phase shift circuit elements of the kind already described. The monolithic integration of the radiator elements and phase shifters permits compact circuit geometries and permits high physical tolerances between the phase shifter and radiator. In the example depicted, each of the four phase shifters 114–117 comprises a 3-bit shifter each including RF MEMS switch modules that, as already described, are coupled to the phase shifter circuit elements on the substrate by means of low loss interconnections preferably employing flip-chip technology.

While several illustrative embodiments of the invention have been disclosed herein, still further variations and alternative embodiments will occur to those skilled in the art. Such variations and alternative embodiments are contemplated, and can be made without departing from the spirit and scope of the invention as defined in the appended claims.

We claim:

1. A hybrid assembly phase shifter comprising:

a phase delay module comprising a substrate carrying a plurality of passive, electrically conductive phase delay elements;

a MEMS module containing a plurality of MEMs switches for coupling selected ones of the phase delay elements between an input and an output; and a low loss interconnection electrically coupling the phase delay elements of the phase delay module with the MEMS switches of the MEMS module, the low loss interconnection comprising a flip-chip interconnection.

2. The phase shifter of claim 1 in which: each of the plurality of passive phase delay elements comprises electrically conductive, planar transmission lines patterned on a surface of the substrate.

3. The phase shifter of claim 1 in which:

the flip-chip interconnection comprises an interconnection selected from the group consisting of solder bumps, indium bumps, plated through holes, metal-to-metal thermocompression bonds and conductive polymer bonds.

4. The phase shifter of claim 1 in which: the substrate comprises an insulating material.

5. The phase shifter of claim 4 in which:

the substrate comprises a material selected from the group consisting of alumina, quartz and a microwave ceramic.

6. The phase shifter of claim 1 in which:

the substrate comprises a semi-insulating material.

7. The phase shifter of claim 6 in which:

the substrate material comprises a material selected from the group consisting of a high resistivity silicon and GaAs.

8. A phased array antenna comprising:

a substrate;

a plurality of radiators disposed on the substrate;

a plurality of passive phase shifter circuits disposed on the substrate, each of the plurality of phase shifter circuits being coupled to one of the plurality of radiators and comprising a plurality of phase delay stages connected in series between a transmission signal input and a transmission signal output to phase shift said signal, each of the phase delay stages being capable of imparting a selectable phase delay on a transmission signal so that the signal is delivered to the radiator with a cumulative phase delay determined by the sum of the phase delays imparted by the individual phase delay stages; and a plurality of MEMS switch modules, a respective one of said MEMS switch modules being coupled to each phase delay stage and operable to electrically connect selected delay stages to provide said cumulative phase delay, the respective MEMS switch modules being coupled to said phase delay stages by low loss interconnections, the low loss interconnections comprising flip-chip interconnections.

9. The assembly of claim 8 in which:

the substrate comprises a semi-insulating material.

10. The assembly of claim 9 in which: the substrate material comprises a material selected from the group consisting of a high resistivity silicon and GaAs.

11. The assembly of claim 8 in which:

the flip-chip interconnections comprise interconnections selected from the group consisting of solder bumps, indium bumps, plated-through holes, metal-to-metal thermocompression bonds and conductive polymer bonds.

12. The assembly of claim 8 in which:

each of the phase delay stages includes a plurality of phase delay elements comprising true time delay lines of different lengths.

13. The assembly of claim 12 in which: the true time delay lines comprise electrically conductive, planar transmission lines patterned on a surface of the substrate.

14. The assembly of claim 8 in which: the substrate comprises an insulating material.

15. The assembly of claim 14 in which:

the substrate comprises a material selected from the group consisting of alumina, quartz and a microwave ceramic.

* * * * *